United States Patent [19]

Milke et al.

[11] 3,967,153

[45] June 29, 1976

[54] FLUORESCENT LAMP HAVING ELECTRICALLY CONDUCTIVE COATING AND A PROTECTIVE COATING THEREFOR

[75] Inventors: Howard W. Milke, Danvers; Tadius T. Sadoski, Salem, both of Mass.

[73] Assignee: GTE Sylvania Incorporated, Danvers, Mass.

[22] Filed: Nov. 25, 1974

[21] Appl. No.: 526,488

[52] U.S. Cl. ..... 313/489; 313/198; 313/221; 313/492

[51] Int. Cl.[2] ..... H01J 61/30; H01J 61/42; H01J 61/54

[58] Field of Search ..... 313/485, 488, 489, 221, 313/197, 198, 493, 492

[56] References Cited

UNITED STATES PATENTS

| | | | |
|---|---|---|---|
| 2,386,277 | 10/1945 | Smith | 313/489 X |
| 3,067,356 | 12/1962 | Ray | 313/221 |
| 3,624,444 | 11/1971 | Berthold et al. | 313/221 |
| 3,717,781 | 2/1973 | Sadoski et al. | 313/488 |
| 3,809,944 | 5/1974 | Jongerius et al. | 313/488 X |

*Primary Examiner*—Palmer C. Demeo
*Attorney, Agent, or Firm*—James Theodosopoulos

[57] ABSTRACT

A fluorescent lamp has a transparent electrically conductive coating on the inner surface of the fluorescent lamp bulb. A transparent protective coating of finely powdered aluminum oxide is disposed on the conductive coating.

3 Claims, No Drawings

FLUORESCENT LAMP HAVING ELECTRICALLY CONDUCTIVE COATING AND A PROTECTIVE COATING THEREFOR

THE INVENTION

This invention concerns fluorescent lamps, that is, low pressure mercury vapor discharge lamps having a glass bulb whose inner surface contains a layer of luminescent material and which has electrodes at each end of the lamp. The invention is particularly concerned with fluorescent lamps having a transparent electrically conductive coating on the inside surface of the lamp.

It is well-known in the fluorescent lamp industry that the starting voltage requirement of a fluorescent lamp is influenced by the bulb wall surface resistance. By using a conductive coat on the inner wall surface, it is possible to reduce the voltage necessary for ignition of a fluorescent lamp.

Various techniques for the formation of a conductive coat are known. For example: the spray application of tin chloride solutions on a hot substrate; the spray application of various tin organic compounds on a hot substrate; the application of indium organic compounds to a cold bulb followed by baking the bulb in an air atmosphere. Such conductive coatings are especially useful in the case of fluorescent lamps which contain an amalgam-forming material and in the case of certain gas mixtures which are well-known to be difficult to start.

However, lamps having such conductive coatings have several disadvantages. One of them is their tendency to reduce lamp maintenance, which is the lamp light output throughout the life of the lamp compared with initial lamp light output. Another disadvantage is the tendency of the conductive coat to discolor and turn gray during lamp life.

We have found that providing a protective layer of aluminum oxide on the conductive layer tends to overcome these disadvantages. The aluminum oxide is applied in a finely powdered form and in a layer that is thin enough so as to be substantially transparent to the visible light emitted by the lamp.

In one example, a glass bulb for a fluorescent lamp was coated on the inner surface with a conductive coating of indium oxide. The conductive coating was then over-coated with a protective layer of powdered aluminum oxide which was applied by flush-coating the inside of the bulb with aluminum oxide suspension. The suspension was prepared by mixing 3 pounds 5 ounces of Alon C, a finely powdered aluminum oxide having a particle size range of 5 to 40 millimicrons, with 15 gallons of ethylcellulose vehicle and 300 cc of Armeen CD, an amine type dispersing agent. The ethylcellulose vehicle consisted of 2.5% ethylcellulose, 1.2% dibutyl phthalate, 84.6% xylol and 11.7% butanol and had a 12 second viscosity.

After drying, the aluminum oxide coating was baked in air so as to remove the organic matter therefrom. A phosphor coating was then deposited on the aluminum oxide coating and the lamp was completed by usual methods. Life tests showed that lamp maintenance was increased because of the protective alumina coating.

In another example, alumina protective coatings were applied to tin oxide conductive coatings in F40T12 fluorescent lamps. The tin oxide conductive coatings were applied by three different methods.

In one method, an aqueous solution of tin tetrachloride and hydrochloric acid was sprayed on the inner surface of a bulb which was at a temperature of approximately 500°C. These lamps were designated as Group A. In Group B, the bulbs were sprayed with a solution containing anhydrous tin tetrachloride and ammonium fluoride in methyl alcohol, while in Group C, the solution consisted of anhydrous tin tetrachloride in methyl alcohol.

In Group A, the lamps without the alumina protective coating had a 100 hour maintenance of 93.6% while the lamps with the alumina protective coating had a 100 hour maintenance of 96.2%. The respective 100 hour maintenance figures for the Group B lamps were 94.1% and 96.1% and for the Group C lamps, 79.7% and 98.4%. Thus in all three cases, the alumina protective coating significantly improved lamp maintenance.

The advantages of the alumina protective coating of this invention are probably due to the fact that the relatively nonporous alumina coating protects the electrically conductive coating from ion bombardment resulting from the arc discharge. Even though the phosphor layer overlays the conductive coating, and is many times thicker than the alumina protective coating, it does not similarly protect the conductive coating from ion bombardment, probably because it is more porous and a poorer electrical insulator than the alumina coating.

The thickness of an alumina coating in accordance with this invention was measured by electron photomicrograph and found to be about 500 nanometers or about 0.02 mils. This is considerably thinner than the alumina coating that is sometimes used in fluorescent lamps to prevent formation of a mercury-alkali discoloration, as disclosed in U.S. Pat. No. 3,067,356. In such cases, the alumina coating is applied directly to the glass and must be at least 0.5 mils thick in order to form a physical-chemical barrier that effectively prevents alkali from the glass from reacting with mercury that is present in the lamp fill.

We claim:

1. A fluorescent lamp comprising a glass envelope having electrodes at each end thereof, a transparent electrically conductive layer coated on the inner surface of the glass envelope, a transparent layer of finely powdered aluminum oxide coated on the electrically conductive coating and a layer of luminescent material coated on the aluminum oxide layer.

2. The lamp of claim 1 wherein the electrically conductive layer comprises tin oxide or indium oxide.

3. The lamp of claim 1 wherein the aluminum oxide layer is about 500 nanometers thick.

* * * * *